US005390594A

United States Patent [19]

Nobile et al.

[11] Patent Number: 5,390,594

[45] Date of Patent: Feb. 21, 1995

[54] TAPE FEEDING, CUTTING AND EJECTING APPARATUS FOR A MAILING MACHINE

[75] Inventors: John R. Nobile, Fairfield; William A. Salancy, Norwalk, both of Conn.

[73] Assignee: Pitney Bowes Inc., Stamford, Conn.

[21] Appl. No.: 180,168

[22] Filed: Jan. 11, 1994

[51] Int. Cl.[6] ..... B41L 47/46

[52] U.S. Cl. ..... 101/92; 400/621; 400/613; 101/227; 235/101; 396/136

[58] Field of Search ..... 400/613, 613.1, 614, 400/617, 621; 101/91, 92, 93, 226, 227, 228; 226/11, 91, 92, 143; 235/101; 177/4, 145; 83/203, 509, 200; 364/464.1; 346/134, 136

[56] References Cited

U.S. PATENT DOCUMENTS

| | | | |
|---|---|---|---|
| 3,372,848 | 3/1968 | MacDonald et al. | 226/11 |
| 3,565,283 | 2/1971 | Sciacero | 221/197 |
| 3,583,314 | 6/1971 | Gillender | 235/101 X |
| 3,749,013 | 7/1973 | Ellner | 101/227 |
| 3,885,482 | 5/1975 | Denzin | 83/241 |
| 4,396,926 | 8/1983 | Manning et al. | 346/145 |
| 4,580,144 | 4/1986 | Calvi | 235/101 X |
| 4,860,031 | 8/1989 | Lejcek | 346/136 |
| 4,957,179 | 9/1990 | Dannett | 101/91 X |
| 5,171,975 | 12/1992 | Lyga | 101/91 X |

*Primary Examiner*—Edgar S. Burr
*Assistant Examiner*—Christopher A. Bennett
*Attorney, Agent, or Firm*—Melvin J. Scolnick; David E. Pitchenik; Steven J. Shapiro

[57] ABSTRACT

Disclosed is a tape feeding, cutting and ejecting apparatus for a mailing machine which has a feed deck for feeding envelopes therealong and a postage meter for printing postage indicia on successive envelopes as they are fed along the feed deck. The tape feeding, cutting and ejecting apparatus is mounted in the mailing machine above the feed deck and adjacent to the postage meter on the side thereof opposite to the direction of the feed of envelopes for feeding successive finite lengths of tape to the postage meter for printing of postage indicia on a portion thereof and for cutting and ejecting the printed portion of the finite lengths of tape from the mailing machine. The apparatus includes a tape holding assembly and means for pivotally mounting the tape holding assembly for movement between a normal operating position and an operator accessible position to facilitate loading and threading of a fresh roll of tape. The apparatus also includes a sensing means for sensing when the tape holding assembly is not in the normal operating position and also when the tape supply is exhausted.

12 Claims, 6 Drawing Sheets

TAPE FEEDING, CUTTING AND EJECTING APPARATUS FOR A MAILING MACHINE

BACKGROUND OF THE INVENTION

The present invention relates generally an apparatus for feeding tape to the postage meter of a mailing machine for printing of a postage indicia thereon, and more particularly to an improved tape feeding, cutting and ejecting apparatus which facilitates loading fresh rolls of tape, threading the lead edge of fresh tape through the apparatus and preventing operation of the apparatus if certain parts are not in a proper operating position.

The present invention is an improvement on the tape feeding, cutting and ejecting apparatus disclosed and claimed in copending U.S. patent application Ser. No. 08/180,163, filed on Jan. 11, 1994, in the names of Morton Silverberg, William A. Salancy and Steven A. Supron, and copending U.S. patent application Ser. No. 08/180,161, filed on Jan. 11, 1994 in the name of John R. Nobile, William A. Salancy and Irena Makarchuk, both assigned to the assignee of this application.

Although the tape feeding, cutting and ejecting apparatus disclosed and claimed in the first above mentioned copending application worked in principle, it became apparent after building and operating that apparatus that it had a number of functional problems which would have a substantial adverse impact on the marketability of mailing machines incorporating that apparatus. One of these problems was that there was no provision for moving a tape holding device from a normal operating position within the confines of the mailing machine to an exposed position in which the tape holding parts of the apparatus were accessible to an operator who could then easily and quickly install a fresh roll of tape. One of the most important characteristics of mailing machines, considering the generally non-technical nature of most mailing machine users, is that the machines be "user friendly." A mailing machine in which the roll of tape can be replaced only with considerable difficulty is not user friendly.

Another problem with the prior machine was that it was difficult to initially thread the leading edge of a fresh roll of tape into the feeding, cutting and ejecting apparatus because of the manner in which the apparatus was mounted in the mailing machine. Again, if tape cannot be easily threaded into the apparatus by an average user, the mailing machine is not user friendly.

A still further problem was that the prior apparatus had no provision for sensing the end of the tape to prevent further operation of the apparatus after the tape supply became exhausted. One solution to this problem in any form of web feeding machine is to provide some form of mark on the web along a terminal portion thereof to advise an operator of the machine that there is only a small amount of tape or web left on the roll and that the roll should be replaced. This is satisfactory where marks on the web are acceptable during final operations of the machine. But in a postage meter, spurious markings on the tape along with the authorized postage indicia would not be acceptable.

Another deficiency with the prior apparatus was that there was no provision for preventing operation of the postage meter in the event that the door of the mailing machine which housed the feeding, cutting and ejecting apparatus was not fully closed. Thus, if an operator inadvertently pushed the appropriate "start" button with parts of the apparatus or the mailing machine out or normal operating positions, the machine could jam or otherwise malfunction, and possibly even be a safety hazard to the operator.

BRIEF SUMMARY OF THE INVENTION

The present invention addresses these shortcomings and disadvantages of the prior tape feeding, cutting and ejecting apparatus, and provides solutions which at least obviate if not altogether eliminate these problems. For example, the problem of not being able to easily access the tape roll for replenishing tape and threading the tape into the apparatus has been solved by providing a means for moving a tape roll holding element from a normal operating position within the confines of the mailing machine to an operator accessible position in which an operator can easily remove the spindle of an exhausted roll of tape and install a fresh roll without having to manipulate any difficult to reach parts of the mailing machine or of the feeding, cutting and ejecting apparatus.

The problem of encountering difficulty in threading the leading edge of a fresh roll of tape into the feeding, cutting and ejecting apparatus has been solved,partly by the improvement mentioned in the preceding paragraph, and partly by providing a semi-automatic threading arrangement in which the operator merely inserts the leading edge of the tape into a slot and then turns a hand knob which causes a feed roller to pick up the leading edge of the tape and feeds it through a guide path until the leading edge passes a cut-off edge Which defines the normal starting position of the leading edge of the tape in the apparatus.

Also, the problem of providing an indication that the apparatus is about to run out of tape and of preventing further operation of the mailing machine and the feeding, cutting and ejecting apparatus if the former occurs has been eliminated by providing an end of tape sensor which senses the arrival of the end of the tape at a particular location and then prevents further operation of both the mailing machine and the feeding, cutting and ejecting apparatus. In addition, the sensor is constructed and arranged so that it also detects that the tape holding device of the apparatus is not in a proper operating position, which means also that a cover on the mailing machine housing which normally encloses the feeding, cutting and ejecting apparatus is not fully closed, in which case the mailing machine should not be operated. In this event, the mailing machine is disabled and cannot operate if the operator inadvertently presses the mailing machine start button.

These and other advantages and features of the present invention are achieved by providing an apparatus as hereinafter disclosed and claimed, but which, in its broader aspects, is incorporated in a mailing machine which has a housing including a cover that opens to reveal an interior portion of the mailing machine, an elongate feed deck, means for feeding envelopes along the feed deck, a postage meter mounted in the mailing machine and having a printing mechanism disposed in juxtaposition with the feed deck so as to print a postage indicia on successive envelopes as they are fed along the feed deck. In this environment, the invention is a tape feeding, cutting and ejecting apparatus mounted in the mailing machine beneath the cover of the housing but above the feed deck and adjacent to the postage meter on the side thereof opposite to the direction of feed of envelopes along the feed deck for feeding successive uncut finite lengths of tape to the postage meter for printing of postage indicia on a portion thereof and for cutting and ejecting the printed portion of the finite lengths of tape from the mailing machine.

The apparatus comprises means for holding a supply roll of tape of indefinite length, means defying a first feed path extending from the tape supply roll to the printing mechanism of the postage meter, and means defining a second feed path which extends from a point on the first feed path away therefrom in a direction generally opposite to that in which the first feed path extends toward the printing mechanism. There is a means for feeding a finite length of tape from the tape supply roll along the first feed path to bring a portion of the finite length of tape to the printing mechanism of the postage meter for printing of a postage indicia on the portion of the finite length of tape. There is also a means for severing the printed portion of the finite length of tape and a means for ejecting the severed printed portion of the finite length of tape from the mailing machine along the second feed path. There is a means pivotally mounting the tape holding means in the apparatus for movement between a normal operating position in which the tape holding means is disposed within the housing of the mailing machine and an operator accessible position in which the tape holding means is disposed outside of the housing of the mailing machine. Finally, there is a sensing means responsive both to movement of the tape holding means from the normal operating position toward the operator accessible position for providing an indication that the tape holding means is not in the normal operative position, and to the absence of tape in the first feed path for providing an indication that the tape is exhausted.

In some of its more limited aspects, the tape holding means is mounted in such a way that it can pivot upwardly and outwardly of the mailing machine housing by approximately a 90° angle so that, in its operator accessible position, the tape holding means is fully accessible to an operator for replacing a roll of tape and for threading the tape into the feeding means. Also, the arrangement is such that the tape holding means is contacted by the under surface of the cover on the housing of the mailing machine to retain the tape holding means in its normal operating position when the cover is in its closed position. Further, the tape holding means is spring loaded to be biased away from the normal operating position to an intermediate position slightly raised above the normal operating position, and the apparatus is provided with a sensing means which senses that the tape holding means has moved to the intermediate position, thereby providing an indication that the tape holding means is not in its normal operating position, and therefore that the cover of the mailing machine housing is not fully closed, in which case the mailing machine should not be operated. The same sensing means is also utilized as an end of tape detector to provide an indication that a fresh roll of tape is required.

Having briefly described the general nature of the present invention, it is a principal object thereof to provide an improved tape feeding, cutting and ejecting apparatus for a mailing machine in which an operator .can easily load fresh rolls of tape onto a tape holding means that can be moved from a normal operating position to an operator accessible position.

Another object of the present invention is to provide a tape feeding, cutting and ejecting mechanism in which the operator can easily and conveniently thread the leading edge of the tape into the feeding components .of the tape feeding, cutting and ejecting apparatus.

Still another object of the invention is to provide a tape feeding, cutting and ejecting mechanism which provides the operator with an indication of when the supply roll of tape is exhausted and requires replacement, and also when the tape holding means of the apparatus is not in a normal operating position, which is also an indication that a cover on the mailing machine housing is not fully closed, in which case the mailing machine should not be operated.

These and other objects and features of the present invention will become more apparent from an understanding of the following detailed description of a presently preferred embodiment of the invention, when considered in conjunction with the accompanying drawings.

DETAILED DESCRIPTION OF THE INVENTION

Figure 1:
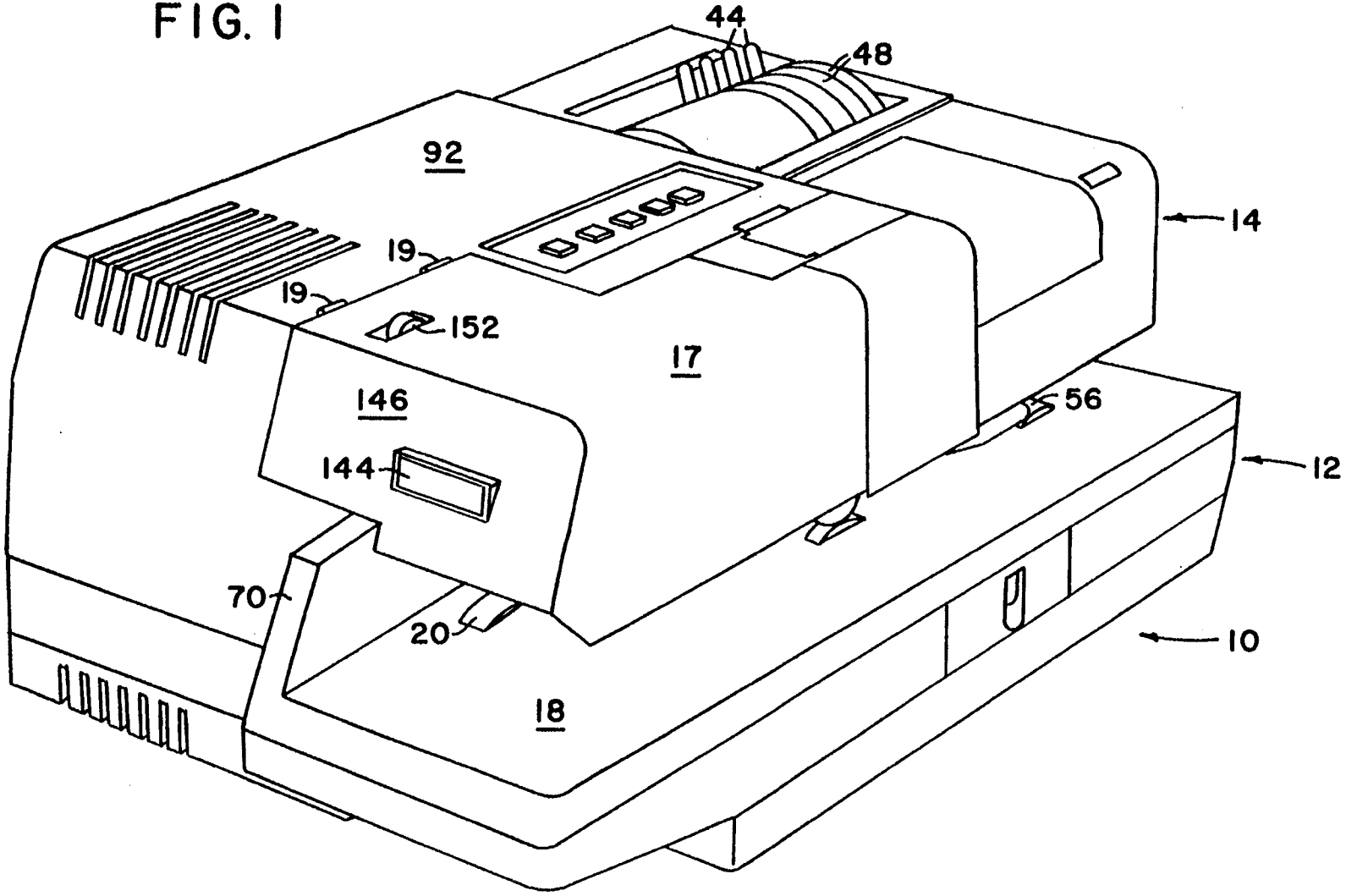
FIG. 1 is a front perspective view of a mailing machine which incorporates the tape feeding, cutting and ejecting apparatus of the present invention.
Figure 2:
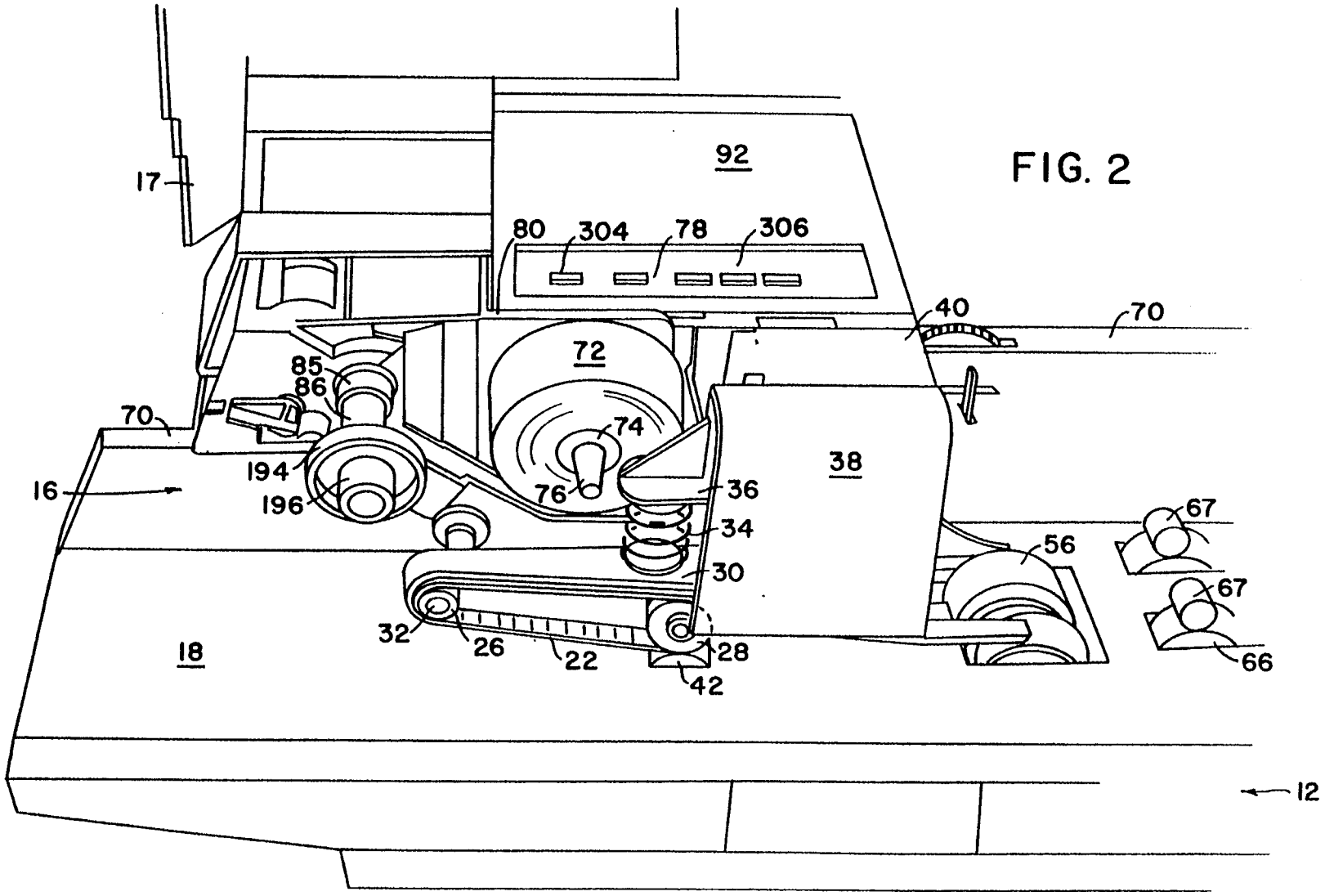
FIG. 2 is a front perspective view of the mailing machine shown in FIG. 1 with the cover of the mailing machine housing raised to expose the tape, feeding and cutting apparatus of the invention, and also with the postage meter removed to reveal certain detail.

Referring now to the drawings and particularly to FIGS. 1 and 2 thereof, there is seen a mailing machine designated generally by the reference numeral 10, of the type described in the aforementioned copending applications which would be considered a mid-range sized mailing machine having the capability of printing postage indicia either on envelopes passing through the mailing machine or on gummed or adhesive backed tape for manual affixation to an envelope. The mailing machine 10 includes a base designated generally by the reference numeral 12, a postage meter designated generally by the reference numeral 14, and a tape feeding, cutting and ejecting apparatus designated generally by the reference numeral 16 (FIG. 2). The mailing machine 10 also includes a housing having a pivoted cover 17 connected by suitable hinges 19 to the housing which can be raised as seen in FIG. 2 to provide access to the tape feeding, cutting and ejecting apparatus. It should be understood that, although mailing machines in general are highly complex in mechanical construction, the following description is simplified in the interest of brevity to include only so much structure of the mailing machine 10 as is necessary for an understanding of the present invention.

The base 12 includes a generally rectangular flat feed deck 18 which extends through the mailing machine 10 from one end to the other and serves to support envelopes and other mail pieces as they are fed through the mailing machine 10 in a left to right direction as the mailing machine is viewed in FIG. 1. The base 12 also includes feeding means such as one or more feed rollers 20 which project slightly above the surface of the feed deck 18 through suitable openings therein to engage the underside of envelopes as they move along the feed deck 18. The envelopes are fed to the postage meter 14 by a belt 22 which extends around a drive pulley 26 and an idler pulley 28 and which engages the upper surface of the envelopes. The outer surface of the belt 22 passing around the idler pulley 28 is mounted on an elongate housing 30 which is pivoted about the shaft 32 which drives the drive pulley 26, and the housing 30 is spring loaded downwardly by the spring 34 captured between the upper surface of the elongate housing 30 and a suitable bracket 36 formed on a portion of an ink cartridge housing 38 which holds a removable ink cartridge 40. The belt 22, as it passes around the idler pulley 28, engages an idler roller 42 mounted beneath the feed deck 18 which acts as a pressure backup to the idler pulley 28 to ensure proper feeding of the envelopes between the belt 22 and the idler roller 42.

Figure 3:
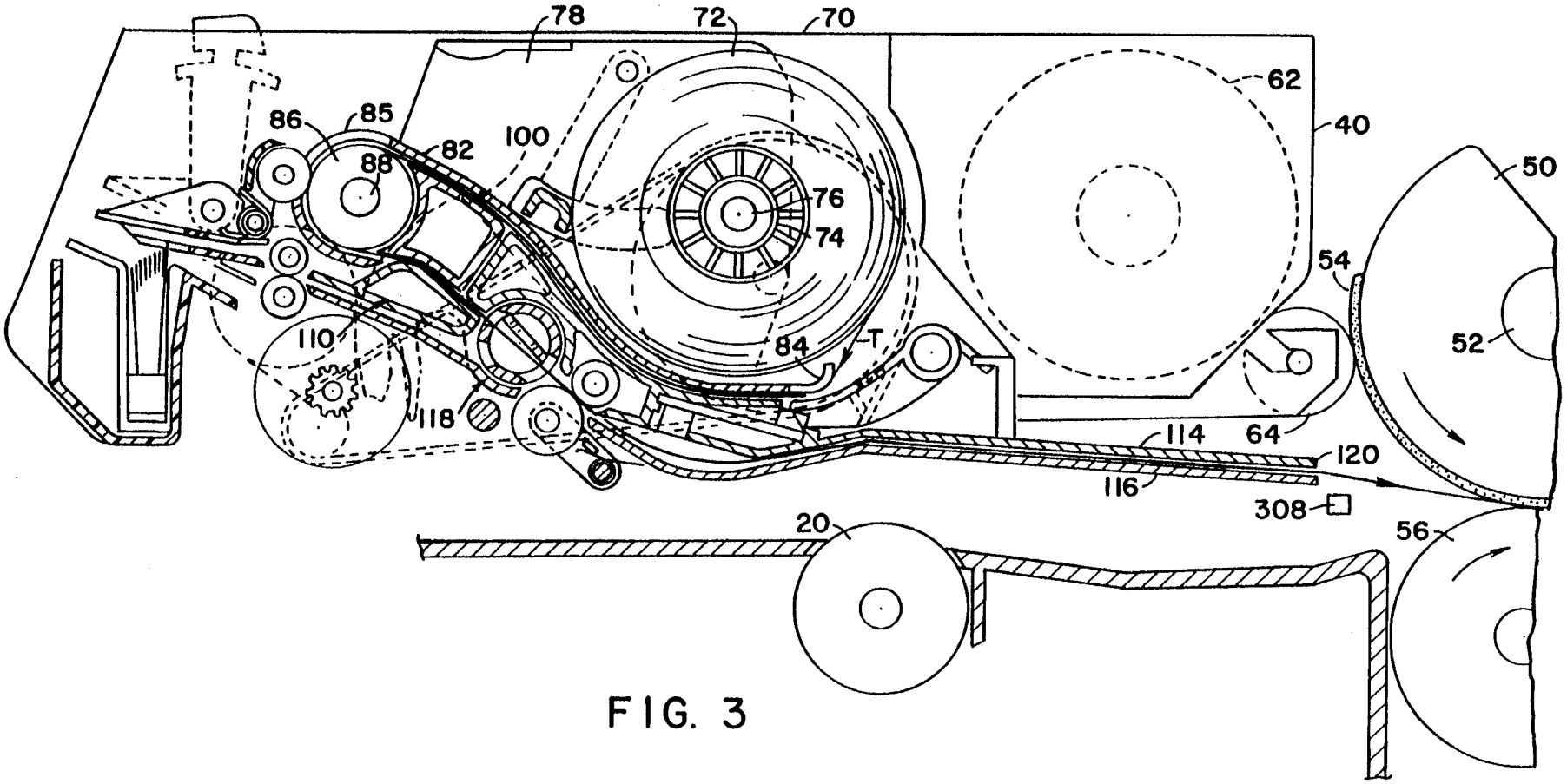
FIG. 3 is a front view of the tape feeding, cutting and ejecting apparatus of the present invention shown in place in the mailing machine, and showing the tape being fed toward and into the postage meter for the printing of the postage indicia thereon.

The postage meter 14 is suitably mounted on the base 12 adjacent to the downstream end of the feed deck 18 and is suitably latched in place. As best seen in FIG. 1, the postage meter includes a plurality of setting levers 44 by which the amount of postage is changed as needed, the levers 44 lining up with numerical indicia on the sliding scales 48. As best seen in FIG. 3, the postage meter 14 also includes a printing drum 50 mounted on a shaft 52 which is suitably driven to rotate in a counter clockwise direction. The printing drum 50 carries a printing die 54 which has the image of the postage indicia embossed thereon. The base 12 includes a plurality of impression rollers 56 which engage the underside of envelopes passing thereover to press the envelopes into firm engagement with the printing die 54 so as to cause ink on the printing die 54 to be transferred to the upper surface of the envelope. The postage meter 14 also includes an inking device consisting of an ink cartridge 62 rotatably mounted in an ink cartridge holder 40 which contacts a spring loaded transfer roller 64 for transferring ink from the cartridge 62 to the image surface of the printing die 54 each time the printing drum 50 makes a revolution.

The base 12 further includes a plurality of eject rollers 66 (FIG. 2) and cooperating spring loaded pressure rollers 67 which engage the envelope as it exists from the nip of the printing die 54 and the impression rollers 56 to ensure that the envelope is conveyed to the end of the feed deck 18.

Figure 4:
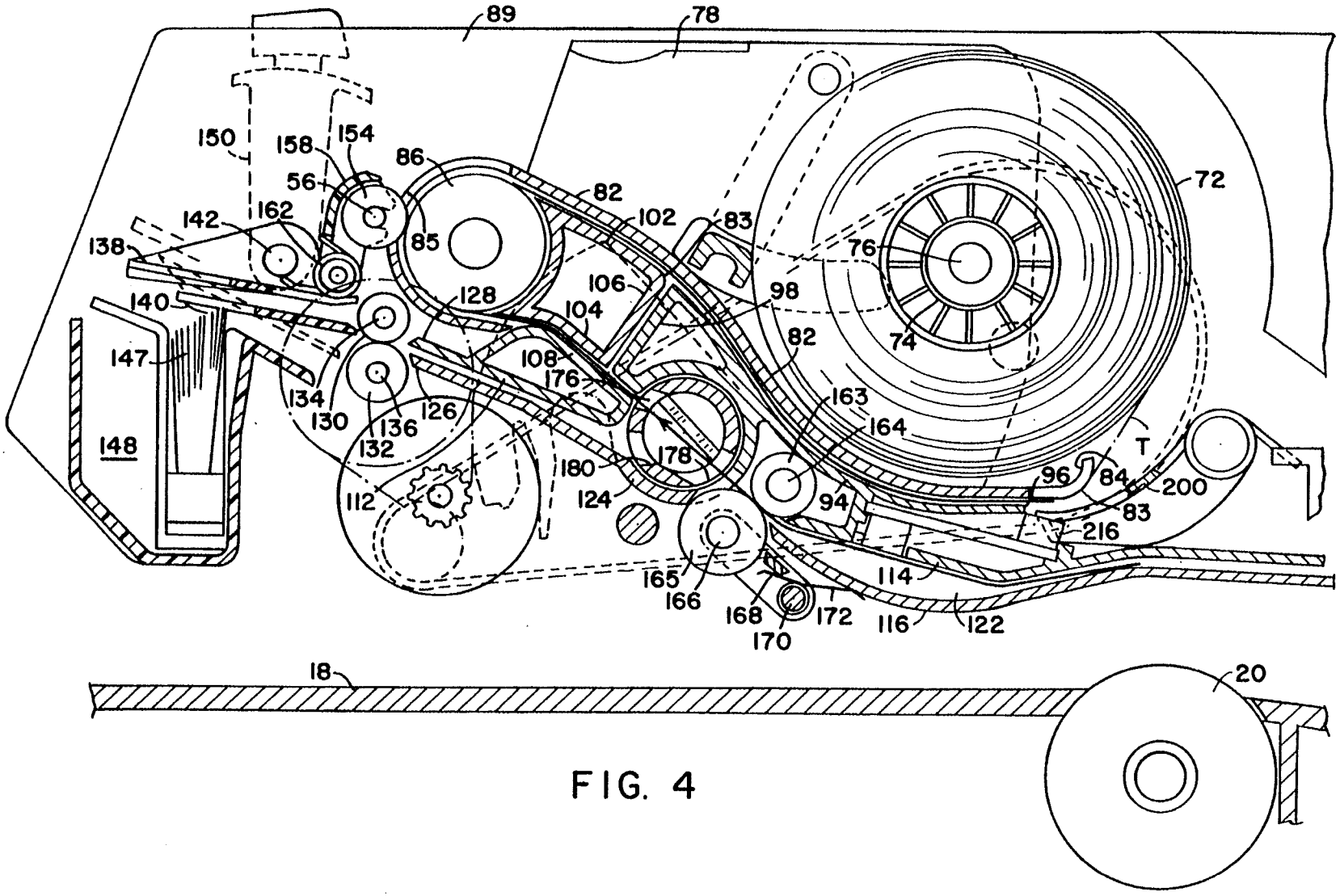
FIG. 4 is a view similar to FIG. 3 but drawn to an enlarged scale and partly in longitudinal section to reveal certain details of construction, and illustrating the tape being fed in the opposite direction to withdraw the printed portion thereof from the postage meter.

Coming now to the essential features of the invention, and referring particularly to FIGS. 3 and 4, the base 12 includes a generally elongate upstanding wall 70 (FIGS. 1 and 2) which extends along the length of the feed deck 18 and forms a registration wall for envelopes moving along the feed deck. The tape feeding, cutting and ejecting apparatus 16 is mounted on the upstanding wall 70 generally adjacent to the upstream end of the feed deck 18, that is, in advance of the postage meter 14 in terms of the direction of feed of envelopes along the feed deck 18, with the bottom of the apparatus 16 spaced slightly from the feed deck 18 to permit envelopes to pass between it and the feed deck 18. The tape feeding, cutting and ejecting apparatus 16 includes a roll of tape 72 wound on a spindle 74 which is mounted on a tape holding means which comprises a stub shaft 76 fixed to an upstanding wall 78 of a movable mounting frame designated generally by the reference numeral 80 in FIGS. 2 and 5. The stub shaft 76 is provided with any suitable means for applying some friction to the spindle 74 to prevent the tape roll 72 from overrunning either during feeding of the tape or after feeding has stopped.

The mounting frame 80 also includes an elongate upper guide plate 82, suitably mounted on or formed integrally with the wall 78, which projects outwardly from the wall 78 and which commences at a point located generally adjacent to the bottom of the roll of tape 72, which is also adjacent to the end of the tape feeding, cutting and ejecting apparatus 16 which is proximate to the postage meter 14, with an upturned lip 84 which forms an entrance guide for a strip of tape T as it comes off the roll 72 and enters a tape channel further described below. The upper guide plate 82 terminates adjacent its opposite end in a pair of spaced apart U-shaped portions 85 (FIGS. 2 and 4) which fit closely around the outer periphery of a drum shaped tape feed roller 86 fixedly mounted on a shaft 88 which in turn is rotatably mounted between a pair of spaced apart walls 89 and 91 (FIG. 5) which are the principle structural frame members of the apparatus 16 and between which the other components and parts of the apparatus 16 are mounted. The feed roller 86 preferably has a central portion coated with a suitable high friction material to prevent slippage between the tape T and the feed roller 86 during feeding of the tape.

Figure 5:
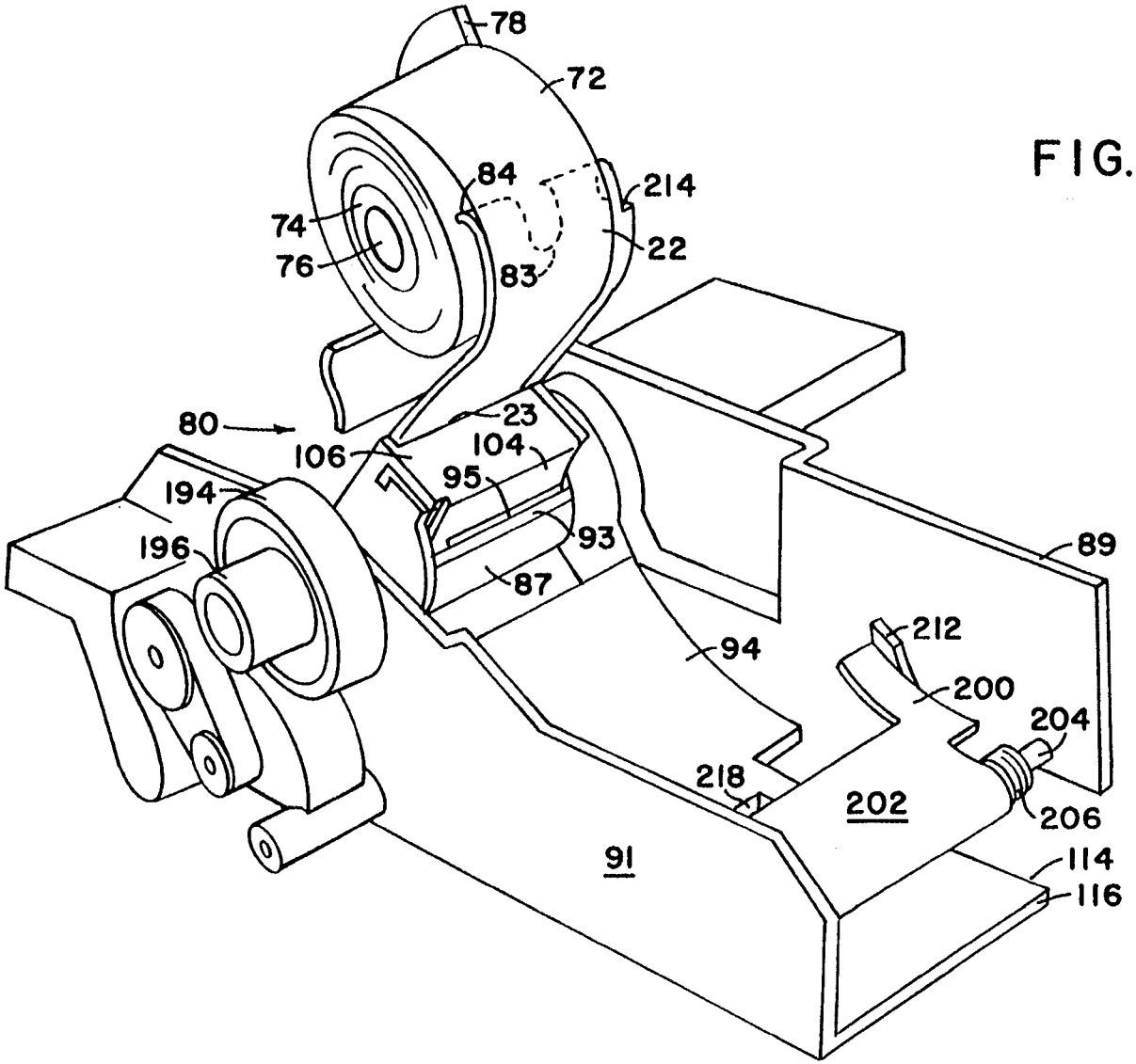
FIG. 5 is a perspective view of the tape feeding, cutting and ejecting apparatus with the tape holding means raised to the operator accessible position.

The U-shaped portion 85 of the mounting frame 80 fits around the feed roller 86 with only sufficient clearance for the mounting frame 80 to pivot upwardly about the feed roller 86 from the normal operating position shown in FIGS. 3 and 4 to the upstanding operator accessible position shown in FIG. 5 in order to facilitate the loading of a fresh tape roll 72 on the shaft 76 when the roll already installed is exhausted. Also, as explained in more detail below, raising the mounting frame 80 to the upright position facilitates easy threading of the lead edge of the tape strip T into the narrow slot 83 formed by the lower surface of the upper guide plate 82 and an upper guide wall 102 (further described below) when the tape roll 72 is replaced. Still further, the U-shaped portions 85 terminate in a flat portion 87 (FIG. 5) which extends across the width of the feed roller 86 and which is tapered adjacent to the free end thereof to form a cutting edge 93 (FIGS. 5 and 6) against which the free end of the tape T is pulled, after it exits through a slot 95 defined by the cutting edge 93 and the under surface of a lower guide wall 104 (further described below), to cut a clean and squared off end for feeding further into the apparatus 16.

Still referring to FIGS. 3 and 4, an elongate lower guide plate 94 is suitably secured to or formed integrally with the wall 89 and is disposed contiguously with the upper guide plate 82 over most of its length, commencing with an end 96 located adjacent to the lip 84 on the upper guide plate 82 and extending rearwardly to a downwardly extending wall 98 which is disposed in spaced relationship with the tape feed roll 86 toward the end of the apparatus 16 that is proximate to the postage meter 14.

An upper intermediate guide portion designated generally by the reference numeral 100 in FIG. 3 is suitably mounted on or formed integrally with the wall 78, and disposed in the space between the downwardly extending wall 98 and the tape feed roller 86, and includes an upper guide wall 102, which is disposed in closely spaced relationship with the portion of the upper guide plate 82 which extends beyond the lower guide plate 94, a lower guide wall 104, and an upright wall 106 connected between the upper and lower side walls 102 and 104. The lower guide wall 104 is disposed in closely spaced relationship with an upper guide wall 108 of a lower intermediate guide portion designated generally by the reference numeral 110 in FIG. 3, and which is also suitably mounted on or formed integrally with the frame wall 89. This intermediate guide portion 110 has a lower guide wall 112, the purpose of which will be made clear hereinbelow.

A second set of elongate upper and lower guide plates 114 and 116 respectively are suitably mounted on or formed integrally with the frame wall 89 and extend generally from a point adjacent to a severing mechanism indicated generally by the reference numeral 118 in FIG. 3 (further described hereinbelow), to another point 120 adjacent the nip of the printing drum 50 of the postage meter 14 and the impression roller 56. The upper and lower guide plates 114 and 116 are disposed in closely spaced relationship over most of their length, except for a relatively short span where they are separated by a substantially larger distance to form a gap 122, the purpose of which will be fully explained hereinbelow.

From the description thus far, it will be seen that the first pair of elongate upper and lower guide plates 82 and 94, the upper guide plate 82 and intermediate upper guide wall 102, the U-shaped portion 85 of the mounting frame 80 and feed roller 86, the intermediate lower and upper guide walls 104 and 108, the severing mechanism 118 and the second pair of elongate upper and lower guide plates 114 and 116 all function together as a first guide means defining a first feed path for the tape T which extends generally from beneath the tape supply roll 72 to the postage meter, and which terminates closely adjacent to the printing drum 50 and impression roller 56.

Still referring to FIGS. 3 and 4, another generally elongate guide plate 124 is suitably secured to or formed integrally with the frame wall 89 and extends rearwardly from beneath the severing mechanism 118 to an opposite end 126 located generally beneath the feed roller 86. The lower guide wall 112 of the intermediate guide portion 110 also has an end 128 located adjacent to the end 126 of the guide plate 124. The guide plate 124 and the guide wall 112i are closely spaced from one another over that portion of the guide plate 124 which is contiguous with the guide wall 112 to form a narrow channel therebetween for the tape T, as best seen in FIGS. 7 and 9 and further described hereinbelow.

A pair of feed rollers 130 and 132 are mounted on shafts 134 and 136 respectively which are rotatably mounted in the frame wall 89 and front wall 91, the feed rollers 130 and 132 being located immediately adjacent to the ends 126 and 128 of the guide plate 124 and guide wall 112 respectively. The operation of these feed rollers will be explained further hereinbelow.

On the opposite side of the feed rollers 130 and 132 is a tape deflector having closely spaced apart upper and lower guide plates 138 and 140 which are suitably connected together to form an integral unit which is fixedly mounted on a shaft 142 pivotally mounted in the frame walls 89 and 91. The deflector plates 138 and 140 lead to an outlet opening 144 (FIG. 1) formed in the side wall 146 of the cover 17. A lever 150 is suitably connected to the shaft 142 and terminates upwardly in a finger button 152 which projects through a top wall 92 (FIG. 1) of the mailing machine housing for access by an operator to oscillate the shaft 142 back and forth to move the deflector plates 138 and 140 between the solid line and dotted line positions shown in FIG. 4. It will be seen that with the deflector plates 138 and 140 in the solid line positions, a cut piece of tape is directed under the deflector plate 140 and over the top of the bristles 147 of a moistening device 148 so as to moisten the lower surface of the cut piece of tape, if it is gummed tape, for immediate application to an envelope. With the deflector plates 138 and 140 in the dotted line positions, the cut piece of tape is directed between the deflector plates 138 and 140 to prevent the tape from contacting the moistening bristles 147, and to direct the piece of tape directly to the outlet opening 144.

At this point it should be noted that the lower guide wall 112 and the contiguous portion of the guide plate 124, together with the deflector plates 138 and 140 constitute a means defining a second feed path which extends from a point on the first feed path away therefrom in a direction generally opposite to that in which the first feed path extends toward the end of the tape feeding, cutting and ejecting apparatus which is proximate to the postage meter.

The tape feeding means of the apparatus 16 will now be described, still with reference to FIGS. 3 and 4, and is seen to comprise the tape feed roller 86 previously described, and an idler roller 154 which is rotatably mounted on a shaft 156 which is fixed in an upstanding frame 158, which in turn is pivotally mounted on another shaft 160 supported by the frame wall 89 and the front wall 91. A suitable coil spring 162 is wrapped around the shaft 160 so that the ends thereof bear against the frame 158 and the upper surface of the deflector plate 138 to urge the frame 158 toward the feed roller 86, thereby pressing the idler roller 154 into firm engagement with the tape T as it passes around the feed roller 86.

Another feed roller 163 is fixedly mounted on a shaft 164 which is rotatably mounted in the frame walls 89 and 91, the feed roller 163 being located just after the severing mechanism 118 in the direction of feed of the tape T toward the postage meter 14. A pair of backup idler rollers 165 are fixedly mounted on a shaft 166 which is rotatably mounted in a frame 168 which in turn is pivotally mounted on another shaft 170 which is mounted on the frame walls 89 and 91. A coil spring 172 is suitably mounted on the shaft 170 so that the ends thereof bear against the underside of the guide plate 116 and the frame 168 to urge the idler roller 165 toward the feed roller 163, thereby providing a firm driving engagement between the feed roller 163 and the tape T.

It should be noted that the feed roller 86 and backup idler roller 158, and the feed roller 163 and backup idler roller 165 are all in the first predetermined feed path and serve to feed the tape T both toward the postage meter 14 prior to and during the printing of postage indicia on the tape, and away from the postage meter after the printing operation is completed, to bring the printed portion of the tape to the position in which the tape T is severed, as will be further described hereinbelow in connection with the description of the operation of the apparatus 16. The set of feed rollers 130 and 132 are disposed in the second predetermined feed path and function to eject the severed piece of tape from the apparatus 16, as previously described. The means by which the feed rollers in both the first and second predetermined feed paths are actuated will be described hereinbelow.

The severing mechanism 118, as best seen in FIG. 4, is located at the juncture of the above described first and second feed paths, since the severing mechanism 118 also functions as a deflector to deflect the leading edge of the severed portion of tape on which the postage indicia is printed from the first predetermined feed path to the second predetermined feed path in the manner now to be described.

Figure 6:
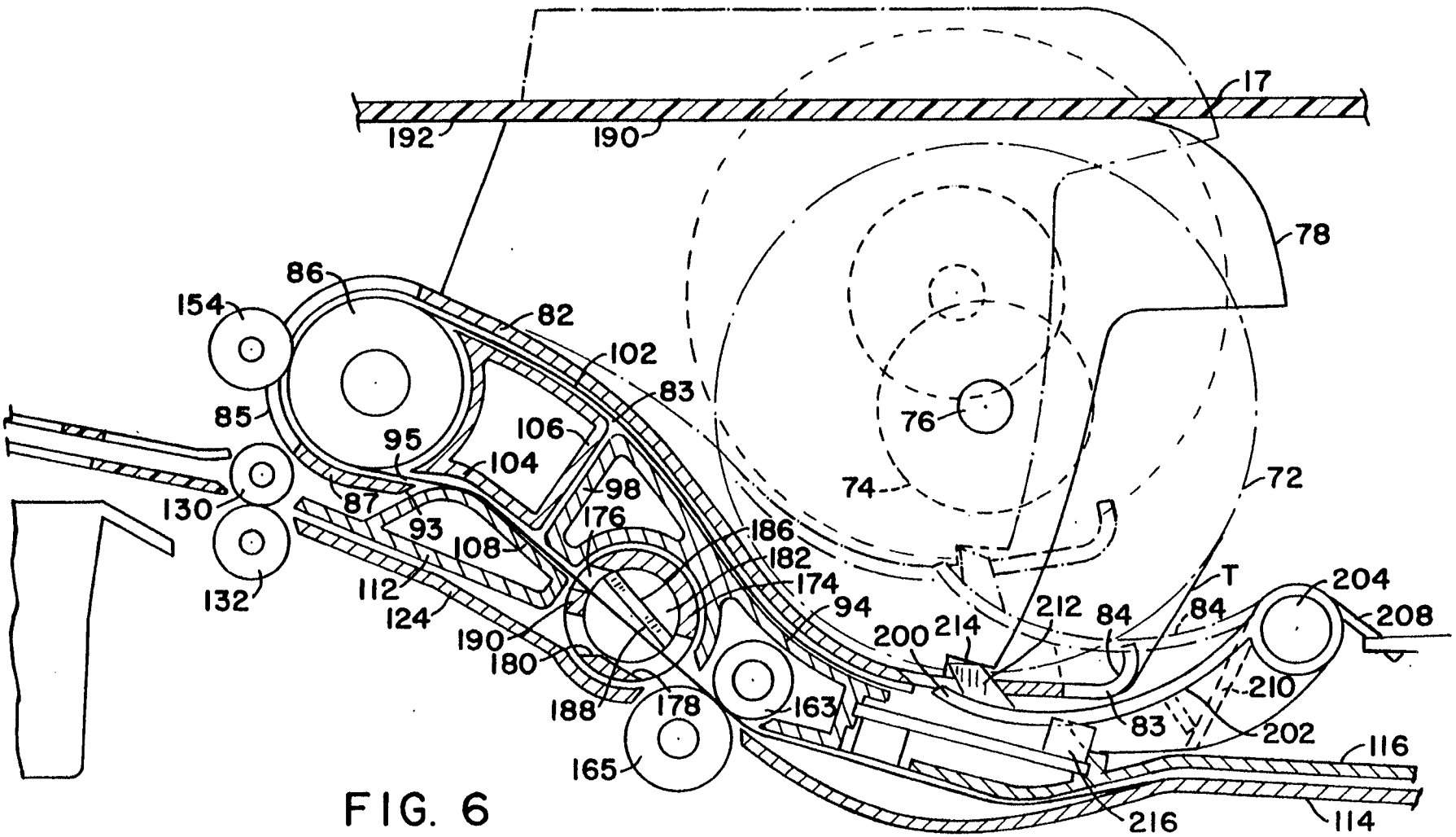
FIG. 6 is a view similar to FIG. 4 but showing the tape holding means raised to an intermediate position to indicate that the cover on the mailing machine housing is not fully closed.

The severing mechanism 118 comprises an elongate, cylindrical tubular member 174 which is suitably fixedly mounted between the frame walls 89 and 91. The tubular member 174 has a plurality of axially elongate slots formed therein through which the tape T passes, both in its forward and reverse movement. As best seen in FIG. 6, a first slot 176 provides an entrance for the tape T into the tubular member 174, and a second slot 178 disposed on the opposite side of the tubular member 174 from the slot 176 and in diametral alignment with the first feed path provides an exit for the tape T, thus the two slots 176 and 178 permitting the tape T to pass through the tubular member 174 in a straight line. A third slot 180 is formed on the same side of the tubular member 174 as the slot 176, but is disposed slightly beneath the slot 176. The slot 178 provides an exit from the tubular member 174 for the severed portion of the tape T and directs the severed piece of tape into the second feed path, as seen in more detail hereinbelow.

A movable cutting member 182 is rotatably mounted in the tubular member 174, the cutting member 182 having a generally semi-cylindrical shape which is formed to have a close tolerance fit within the tubular member 174. The cutting member 182 has a flat surface 186 which is angled slightly from one end of the cutting member 182 to the other, the flat surface 186 defining a sharpened edge 188 which functions as a movable blade to cut the tape T when the cutting member 182 is rotated in a counter clockwise direction as viewed in FIG. 6. The cutting blade 188 cooperates with the lower edge 190 of the tape entrance slot 176 in the manner of a pair of scissor blades due to the angle of the cutting edge 188 relative to the edge 190, so as to gradually cut the tape T along a lateral line. When the cutting blade 188 moves in the aforementioned counter clockwise direction, the cutting blade 188 not only severs the tape but also depresses the leading edge of the cut piece of tape from the fixed cutting edge 190 of the to the lower slot 180 so that further movement of the severed portion of the tape in the reverse direction will be directed along the second feed path between the guide plate 124 and the lower guide wall 112.

From the foregoing description, it should be apparent that the tubular member 174 and the cutting member 182 constitute a severing means disposed in the first feed path for severing the tape at a location and for deflecting the leading edge of the severed portion of tape from the tape entrance slot 176 where the tape is cut to the tape exit slot 180 to be ejected from the mailing machine 10 along the second feed path as previously described.

As briefly set forth above, the pair of U-shaped portions 85 constitute a means pivotally mounting the tape holding means for movement between the normal operating position in which the tape holding means is disposed within the housing of the mailing machine as seen in FIGS. 1 and 6, and the operator accessible position in which the tape holding means is disposed outside of the housing of the mailing machine as seen in FIG. 5, during which the tape holding means pivots through approximately a 90° arc. As best seen in FIG. 6, the wall 78 of the mounting frame 80 includes an upper edge 190 which is adapted to be engaged by the under surface 192 of the cover 17 of the mailing machine when the cover is in its closed position as seen in FIG. 1. But when the cover 17 is moved to its upright position as shown in FIG. 2, it no longer obstructs the movement of the mounting frame 80, which can then be manually moved to the operator accessible position shown in FIG. 6.

In this position, it is very easy for an operator to load a fresh tape roll 72 onto the shaft 76. In addition, it become a relatively simple matter to thread the tape through the initial portion of the first feed path since an initial part of it is exposed and another part of it is provided with a threading mechanism. Thus, as best seen in FIGS. 2 and 5, the apparatus 16 is provided with a finger knob 194 which is fixedly mounted on the shaft 88, the finger knob having a reduced diameter portion 196. Depending on the dexterity preference of the user, either the larger diameter portion 194 or the reduced diameter portion 196 may be grasped and turned in a counter clockwise direction, thereby turning the shaft 88 and the feed roller 86. By pushing the lead edge of the tape into the slot 83 until it is gripped by the nip of the feed roller 86 and the backup roller 154, and then turning the finger knob 194 to rotate the feed roller, the tape is fed around the feed roller 86 until the lead edge emerges through the exit slot 95 defined by the cutting edge 93 and the under surface of the lower guide wall 104. Once the tape has been pulled across the cutting edge 93 and severed, the mounting frame 80 call be lowered to the normal operating position and the apparatus 16 is ready for operation.

As best seen in FIGS. 5 and 6, the apparatus 16 is provided with a means for automatically moving the mounting frame from the normal operating position upwardly toward the operator accessible position for a limited distance, together with a sensing means for sensing this limited movement for the purpose of providing an indication that the mounting frame 80 is not in the normal operating position, which is also an indication that the cover 17 of the mailing machine housing is not fully closed. Thus, the apparatus 16 is provided with a lever 200 which is attached to or formed integrally with a relatively short curved plate 202 which is pivotally mounted on a shaft 204 mounted in the walls 89 and 91. The plate 202 provides a smooth surface for the tape T to bear against when the apparatus is not operating and, consequently, there is no tension on the tape to cause it to maintain contact with the underside of the guide plate 82. Also, the plate 202 pushes the tape upwardly when the mounting frame 80 is in the intermediate position to assure that the tape is moved away from the sensor 216 when the mounting frame 80 is in this position. A coil spring 206 is also mounted on the shaft 204 and has one end tang 208 abutting a portion of the wall 89 and another end tang 210 engaging the under surface of the plate 202, the bias of the spring 206 being such as to urge the plate 202 upwardly. The distal end of the lever 200 is provided with an upstanding finger 212 which is normally engaged with a slot 214 formed in a lower portion of the wall 78, the location of the finger 212 and slot 214 being such that the finger 212 engages the slot 214 when the mounting frame 80 is in its normal operating position, as seen in FIG. 6, and also for a limited distance thereabove, as represented by the dotted line positions of the corresponding parts in FIG. 6. Thus, it will be apparent that when the cover 17 of the mailing machine housing is raised, the mounting frame 80 moves upwardly from the solid line to the dotted line position under the influence of the spring 206 acting through the plate 202, the lever 200 and the finger 212.

A proximity sensor 216 is suitably mounted beneath a portion of the upper guide plate 82 adjacent to the upturned lip 84 and beneath an opening 218 in the lower guide plate 94 so that the sensor 216 has direct access to the tape T when it is passing between the guide plates 82 and 94 when the mounting frame 80 is in its normal operating position. The proximity sensor 216 is of the type that shines a small beam of light onto the surface of the tape, which is reflected back to the sensor, which in turn can sense the amount of light which is reflected to determine the distance between the tare surface and the sensor. When the mounting frame is in the normal operating position, the sensor 216 detects a normal light intensity and may provide a suitable indication that the apparatus is in condition for operation, or it may physically enable the apparatus for operation or both. If the mounting frame is in the dotted line intermediate position shown in FIG. 6, the intensity of the light reflected to the sensor is greatly diminished, and the sensor detects this and either provides a suitable indication that the mounting frame 80 is not in its normal operating position, or physically disables the apparatus 16 from operating.

Another advantage of the proximity sensor 216 is that it also functions as an out of tape sensor, even though the mounting frame 80 remains in its normal operating position. Thus, referring to FIG. 6, if the supply of tape T becomes exhausted, the underside of the elongate guide plate 82 is provided with a slot 83 which is in line with the sensor 216 to prevent light from being reflected back to the sensor 216 when there is no tape present, with the result that if the tape runs out, the sensor 216 will provide the appropriate signal to indicate that a fresh roll of tape must be installed, and may also disable further operation of the mailing machine after the tape printing operation in progress is completed.

A complete description of a cycle of operation of the tape feeding, cutting and ejecting apparatus to feed tape to the printing mechanism of the postage meter, print the postage indicia thereon, retract the tape from the postage meter until the end of the printed portion is adjacent to the cutting edge 188 of the severing mechanism, severing the tape and ejecting the severed portion from the mailing machine will be found in the second above referenced copending application, to which attention is directed for that description. For the purpose of the present disclosure, only that part of the operation of the apparatus 16 need be described that pertains to the invention claimed herein.

Thus, after continued operation for some period of time, the roll of tape will become exhausted, and this will be sensed by the sensor 216 as described above. When this occurs, the sensor will disable the mailing machine and provide an indication that the tape is exhausted, whereupon the mailing machine operator will lift the cover 17 of the mailing machine housing to the open position. This permits the mounting frame 80 to move upwardly to the dotted line position seen in FIG. 6 in response to the bias of the spring 206 acting on the plate 202 and the lever 200. The operator then raises the mounting frame to the operator accessible position shown in FIG. 5, removes the empty tape spindle 74 from the shaft 76 and replaces it with a fresh roll of tape. The operator then passes the free end of the tape under the elongate guide plate 82, inserts the end of the tape into the slot 83 until it is gripped in the nip of the feed roller 86 and backup roller 154. The operator then turns the finger knob 194 until the end of the tape projects through the slot 95, after which he/she cuts the tape against the cutting edge 93 to provide a clean and squared off end for feeding through the remainder of the feedpath. The operator then lowers the mounting frame 80 to the dotted line position of FIG. 5, and closes the door 17 of the mailing machine housing, which in turn presses on the upper edge of the plate 78 of the mounting frame 80 to lower it to the solid line position shown in FIG. 6. The apparatus 16 is again ready for operation.

If for any reason other than to change a roll of tape the cover 17 of the mailing machine housing is opened, the mounting frame 80 will again rise to the dotted line position of FIG. 5, and the sensor 216 will detect this movement and provide the appropriate signal or disable the mailing machine, or both.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. In a mailing machine having a housing including a cover that opens to reveal an interior portion of the mailing machine, an elongate feed deck, means for feeding envelopes along the feed deck, and a postage meter mounted in the mailing machine and having a printing mechanism disposed in juxtaposition with the feed deck so as to print postage indicia on successive envelopes as they are fed along the feed deck, a tape feeding and cutting apparatus mounted in the mailing machine beneath the cover of the housing but above the feed deck and adjacent to the postage meter on the upstream side thereof with respect to the direction of feed of envelopes along the feed deck for feeding successive lengths of tape to the postage meter for printing of postage indicia on a portion thereof and for cutting and ejecting the printed portion of finite lengths of tape from the mailing machine, said apparatus comprising:

A. means defining an elongate frame,

B. means for holding a supply roll of tape of indefinite length,

C. means defining a first feed path extending from said tape supply roll to the printing mechanism of the postage meter, D. means defining a second feed path extending from a point on said first feed path away therefrom in a direction generally opposite to that in which said first feed path extends toward said printing mechanism, E. means for feeding a finite length of tape from said tape supply roll along said first feed path to bring a portion of said finite length of tape to the printing mechanism of the postage meter for printing of a postage indicia on said portion of said finite length of tape, F. means for severing said printed portion of said finite length of tape, G. means for ejecting said severed printed portion of said finite length of tape from the mailing machine along said second feed path, H. means for pivotally mounting said tape holding means for movement between a normal operating position in which said tape holding means is disposed within the housing of the mailing machine, and an operator accessible position in which said tape holding means is disposed outside of the housing of the mailing machine, and I. sensing means responsive both to movement of said tape holding means from said normal operating position toward said operator accessible position for providing an indicating that said tape holding means is not in said normal operating position, and to the absence of tape in said first feed path for providing an indication that the tape on said tape roll is exhausted, whereby when said tape feeding, cutting and ejecting apparatus is in said operator accessible position, said tape holding means is fully accessible to an operator for replacing a roll of tape and for threading the tape through a portion of said first fed path.

2. An apparatus as set forth in claim 1 wherein said tape holding means comprises A. an elongate vertically oriented mounting frame, and B. a shaft projecting outwardly from a front surface of said said mounting frame for holding said roll of tape and on which said roll of tape is easily installed when said mounting frame is in said accessible position.

3. An apparatus as set forth in claim 2 wherein said means for pivotally mounting said tape holding means comprises means for pivotally connecting said mounting frame to a portion of said elongate frame so that said mounting frame pivots through approximately a 90° arc to move said mounting frame from said normal operating position to said operator accessible position, whereby said mounting frame projects upwardly through the opening in the mailing machine housing normally closed by the cover when said mounting frame is in said operator accessible position.

4. Apparatus as set forth in claim 3 wherein said mounting frame includes an upper portion adapted to be contacted by the under surface of the cover of the mailing machine housing when the cover is closed to maintain said mounting frame in said normal operating position.

5. An apparatus as set forth in claim 4 wherein said means for pivotally mounting said tape holding means further comprises means for automatically moving said mounting frame from said normal operating position to an intermediate position in response to the cover of the mailing machine housing being opened, said tape holding means being effective when in said intermediate position to actuate said sensing means to provide said indication that said tape holding means is not in said normal operating position.

6. An apparatus as set forth in claim 5 wherein said means for moving said mounting frame to said intermediate position comprises means interconnected between a portion of said frame and said mounting frame for normally urging said mounting frame upwardly for a limited distance.

7. An apparatus as set forth in claim 6 wherein said means for moving said mounting frame comprises A. a lever having a finger on one end thereof which normally engages with a portion of said mounting frame, B. means for pivotally mounting said lever on a portion of said elongate frame, and C. resilient means interposed between said elongate frame and said lever for urging said lever to pivot about said lever pivotally mounting means in a direction to move said mounting frame upwardly when the cover on the mailing machine housing is raised from a normally closed position.

8. An apparatus as set forth in claim 7 wherein said lever includes a relatively short curved portion adapted to engage and retain said tape when no tension is applied thereto and to assure that said tape moves upwardly with said mounting frame when said mounting frame moves to said intermediate position.

9. An apparatus as set forth in claim 2 wherein said means defining said first feed path comprises a pair of adjacent closely spaced apart elongate guide plates, one of said guide plates being mounted on said mounting frame and movable therewith, the other of said guide plates being mounted on said elongate frame, whereby the portion of said first feed path defined by said elongate guide plates is open to facilitate easy threading of the tape when said mounting frame is in aid operator accessible position.

10. An apparatus as set forth in claim 9 wherein said one guide plate includes a U-shaped portion which extends part way around said tape feeding means and terminates in a cutting edge which is accessible to an operator when said tape holding means is in said operator accessible position.

11. An apparatus as set forth in claim 9 wherein said sensing means comprises a proximity sensor mounted on said frame adjacent said other elongate guide plate in a position to detect the movement of tape disposed between said elongate guide plates when said mounting frame moves upwardly, thereby moving said one elongate guide plate and said tape away from said other elongate guide plate and said proximity sensor.

12. An apparatus as set forth in claim 9 wherein said sensing means is mounted beneath said other guide plate adjacent the free end of said one of said guide plates, said other guide plate being provided with an aperture through which said sensing means detects the presence or absence of tape in said first feed path to provide an indication that the tape has become exhausted when said sensing means fails to detect the presence of tape in said first feed path.

* * * * *